US007665178B2

(12) United States Patent
Strauch

(10) Patent No.: US 7,665,178 B2
(45) Date of Patent: Feb. 23, 2010

(54) SCRAPER BLADE MOUNTING DEVICE

(75) Inventor: Helmut Strauch, Eltmann-Rossstadt (DE)

(73) Assignee: Joh. Clouth GmbH & Co. KG, Hückeswagen (DE)

( * ) Notice: Subject to any disclaimer, the term of this patent is extended or adjusted under 35 U.S.C. 154(b) by 796 days.

(21) Appl. No.: 10/534,224

(22) PCT Filed: Jul. 29, 2003

(86) PCT No.: PCT/EP03/08342

§ 371 (c)(1),
(2), (4) Date: May 6, 2005

(87) PCT Pub. No.: WO2004/042143

PCT Pub. Date: May 21, 2004

(65) Prior Publication Data

US 2006/0054293 A1 Mar. 16, 2006

(30) Foreign Application Priority Data

Nov. 8, 2002 (DE) ..... 102 51 983

(51) Int. Cl.
*A46B 15/00* (2006.01)

(52) U.S. Cl. ..... 15/256.51; 15/236.01

(58) Field of Classification Search ..... 15/256.51; 162/281, 272; 100/174; 101/169, 365; 118/126, 118/261, 413
See application file for complete search history.

(56) References Cited

U.S. PATENT DOCUMENTS

| | | | | |
|---|---|---|---|---|
| 4,367,120 | A * | 1/1983 | Hendrikz | 162/281 |
| 4,665,859 | A * | 5/1987 | Dunlap et al. | 118/126 |
| 5,279,710 | A * | 1/1994 | Aikawa | 162/281 |
| 5,408,720 | A * | 4/1995 | Miles | 15/256.51 |
| 6,202,252 | B1 * | 3/2001 | Harrisson | 15/256.51 |
| 6,328,853 | B1 | 12/2001 | Goodnow et al. | |
| 6,361,656 | B1 * | 3/2002 | Rata | 162/281 |
| 6,447,646 | B1 * | 9/2002 | Hassinen et al. | 162/281 |

FOREIGN PATENT DOCUMENTS

| | | |
|---|---|---|
| DE | 31 36 085 A | 3/1983 |
| EP | 1 186 703 A2 | 8/2001 |
| WO | WO 93/21380 | 10/1993 |

* cited by examiner

*Primary Examiner*—Dung Van Nguyen
(74) *Attorney, Agent, or Firm*—Collard & Roe, P.C.

(57) ABSTRACT

The invention relates to a scraper blade holding device which comprises a cover plate and a base plate. The cover plate and the base plate are pivotable relative to one another about an axis. The axis is formed by a bearing tube, which is a component of the base plate and is arranged in an end region of the base plate.

13 Claims, 2 Drawing Sheets

SCRAPER BLADE MOUNTING DEVICE

CROSS REFERENCE TO RELATED APPLICATIONS

Applicant claims priority under 35 U.S.C. §119 of German Application No. 102 51 938.8 filed Nov. 8, 2002. Applicant also claims priority under 35 U.S.C. §365 of PCT/EP2003/008342 filed Jul. 29, 2003. The international application under PCT article 21(2) was not published in English.

BACKGROUND OF THE INVENTION

1. Field of the Invention

The invention relates to a scraper blade holding device.

2. Prior Art

A scraper blade holding device of that kind can be used in, for example, a paper factory in the context of paper manufacture or in the steel industry. It serves for reception of a scraper blade for the purpose of uniform contact with a rotating roll or roller in order to clean the surface thereof during operation. A roll of that kind can have a width of several metres. The scraper blade provided for cleaning such a roll has to bear as uniformly as possible against the roll at a predetermined angle over the entire length of the roll. In order to achieve this, the scraper blade is generally laid against the roll with a relatively high pressure.

SUMMARY OF THE INVENTION

A scraper blade holding device is already known from WO 93/21380, which comprises two holding elements. A first part of the scraper blade is introduced between the said holding elements. The second part of the scraper blade leads away from the holding elements. One of these holding elements is a plate consisting of a plurality of fibre layers. The number and orientation of these fibre layers is dependent on the desired operating conditions of the scraper blade. For setting and changing the pressure by which the scraper blade bears against the roll there are provided two pneumatic hoses of which—as seen from the scraper blade—one is disposed in front of and one behind a fulcrum. The fulcrum is provided in the middle region of the base plate. The desired pressing pressure of the scraper blade against the roll can be set by suitable pumping up and emptying of the hoses. Moreover, the known device has a flexible seal which is to prevent penetration of dust and other foreign bodies. Since this flexible seal has to extend over the entire length of the roll, realisation thereof is costly. Added to that is the fact that due to the high temperatures arising during operation, heat-resistant seals have to be used, for example Viton seals. This is connected with very high costs.

A scraper arrangement comprising a blade carrier and a scraper blade is known from EP 1 186 703 A2. The blade carrier is arranged at a blade holder to be pivotable about an axis, wherein arranged between the blade carrier and the blade holder is at least one pressure element which is self-assimilating independently of the pressure, i.e. maintains its basic form. A respective pressure element is preferably arranged on each side of the axis. In addition, in the case of this arrangement the axis is disposed in the middle region of the base plate or blade holder. By means of the mentioned pressure elements, which are hoses, the desired pressing pressure of the scraper blade against the roll can be set and in addition, through generation of a suitable counter-pressure, lifting of the scraper blade from the roll can be undertaken. If this known scraper arrangement is used without a seal, frequent cleaning of the device is necessary. However, due to the tight installation situation this is immensely difficult.

The invention has the object of indicating a scraper blade holding device in which the aforesaid disadvantages do not arise.

This object is fulfilled by a scraper blade holding device with the features indicated. Advantageous refinements and developments of the invention are also described.

The advantages of the invention consist particularly in that by virtue of the claimed construction and positioning of the axis a special dirt or dust seal can be eliminated. The rotary bearing advantageously serves at the same time as a dirt or dust seal. Consequently, use of complicated and expensive rubber or Viton seals is not necessary.

The cover plate is preferably connected with a slotted square tube, within which the bearing tube provided in an end region of the base plate is rotatable.

In a further aspect of the invention the cover plate can be removed in simple manner so that cleaning operations within the device and exchange of the air hose are facilitated. In particular, it is not necessary to unscrew a multiplicity of screws in order to be able to remove the cover plate.

If the base plate is contacted by a shoe provided for reception of the cover plate, then guidance of the cover plate during insertion and withdrawal is improved. Moreover, an improved dust and dirt sealing is thereby achieved.

In a further aspect of the invention components disposed in the inner region of the base plate, particularly the pneumatic hose, are protected against contact with the boundary walls, which in part become very hot in operation, of the base plate.

In a further aspect of the invention the scraper blade holding device manages with only one hose. If the hose is filled with air, then depending on the respective air pressure this leads to a stronger pressing of the scraper blade against the roll to be cleaned. In that case a spring is at the same time pulled out or tensioned. If the air is let out of the hose, lifting of the scraper blade off the roll to be cleaned then takes place by the spring contracting again or relaxing. A second hose, as provided in the case of the previously known arrangements, is not necessary. The said spring restoration is necessary, for example, for exchange of the scraper blade.

A part of the cover plate, the square tube, the base plate and the shoe preferably form a substantially dust-tight unit.

BRIEF DESCRIPTION OF THE DRAWINGS

Further advantageous characteristics of the invention are evident from the explanation thereof, by way of example, by reference to the figures. These show designs of a scraper blade device according to two examples of embodiment of the invention.

DETAILED DESCRIPTION OF THE DRAWINGS

Figure 1:
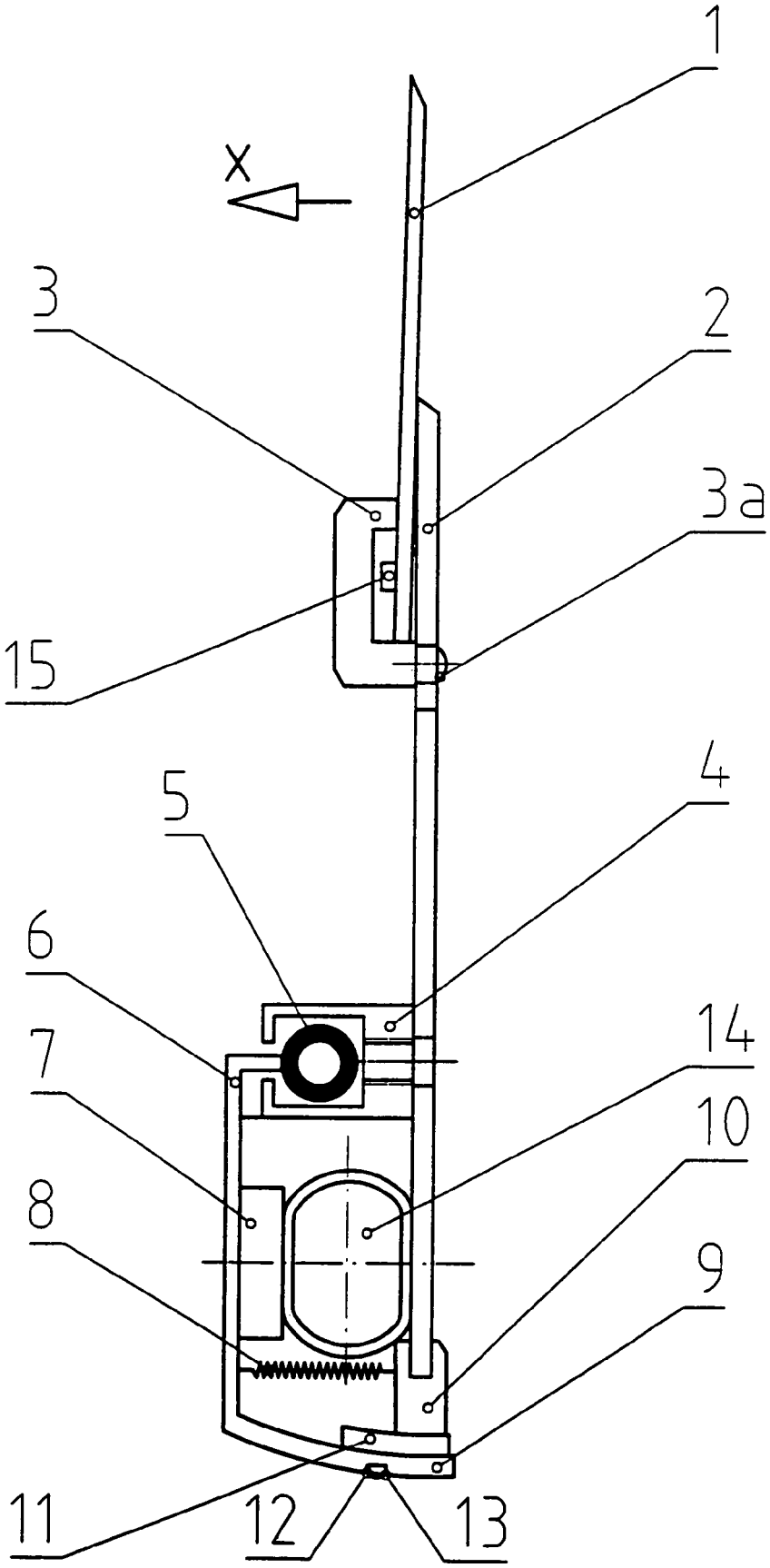

The scraper blade holding device illustrated in FIG. 1 comprises a base plate 6 which is of substantially U-shaped construction and has two short and one long boundary walls. A bearing tube 5 which is a component of the base plate is arranged in the end region of one of the short boundary walls. The bearing tube 5 is mounted within a slotted square tube 5 and rotatable relative thereto through a small angle.

The square tube is fixedly connected with a cover plate 2, preferably by means of a plurality of screw connections which are arranged one after the other perpendicularly to the plane of the drawing, but which are not illustrated in the drawing. The cover plate 2 preferably consists of carbon-fibre material and can comprise several carbon-fibre layers. The cover plate is thereby flexible and can readily adapt to the surface of the respective roll to be cleaned.

Finger devices 3, which are similarly arranged one behind the other perpendicularly to the plane of the drawing, are fastened to the cover plate 2 by means of screw connections 3a in the front end region of the cover plate. The scraper blade 1 is introduced between the cover plate 2 and the finger devices 3. This introduction of the scraper blade is preferably carried out by a pushing in in axial direction. Since the rear end region of the scraper blade is provided with a rivet or spring 15, the scraper blade cannot, in operation, be pulled out in the direction of the roll to be cleaned.

In order to set the respectively desired pressing pressure of the scraper blade against the surface of the roll to be cleaned a pneumatic air hose 5 is provided in the inner region of the U-shaped base plate 6. This hose is provided at one end thereof with an air connection by which air can be forced into the hose and also air can be let out of the hose again. The other end of the hose 14 is closed. A plastics material insert 7 is provided between the hose 14 and the long boundary wall of the U-shaped base plate 6. This is loosely inserted, glued or screw-connected on the inner side of the base plate and prevents the hose 14 from coming into contact with a possibly hot boundary wall during operation of the device.

If the air pressure in the hose 14 is increased, then this expands. This has the effect that in the region of the hose 14 the cover plate 2 is urged away from the base plate 6. This in turn has the consequence that the scraper blade which is fastened in the region of the front end of the cover plate to this, moves in the direction of the arrow x or is pressed in the direction x. The scraper blade is thereby laid against the roll surface to be cleaned and the desired pressing pressure is set by way of a pressure regulating valve.

In addition, a spring 8 is provided in the inner region of the U-shaped base plate 6. One end thereof is connected with the long boundary wall of the base plate 6. The other end of the spring 8 is fastened to a shoe 10 which is provided for reception of the rear end region of the cover plate 2. The shoe forms, in a direction perpendicular to the plane of the drawing, a guide rail within which the cover plate is mounted to be displaceable in axial direction. The shoe is provided with a slide surface 11 arranged parallel to a boundary wall 9 of the U-shaped base plate. The shoe 10 together with the cover plate is pivotable relative to the base plate. This pivotability is given in that slots 13, which extend in radial direction and through which rivets 12 connected with the slide surface 11 of the shoe are guided, are provided in the boundary wall 9 of the base plate.

If the air pressure hose 14 is increased, then the spring is drawn out and the shoe moves to the right in the plane of the drawing so that the spacing of the shoe from the long boundary wall of the base plate increases.

If the scraper blade 1 has to be raised off the roll surface again, for example for a blade change, then the air is let out of the hose 14. The shoe 10 is moved back in the plane of the drawing to the left into its starting position by the spring 8 then contracting again so that the cover plate 2 is pivoted back into its initial setting.

In FIG. 1 there is illustrated by all that a novel scraper blade holding device which does not require additional resilient dust and dirt sealing. This is achieved substantially by the claimed special construction and arrangement of the pivot plane of the scraper blade holding device. The design of the scraper blade holding device according to the invention moreover makes it possible to manage with only one air hose, since bringing about of the initial setting of the cover plate takes place with use of a relaxing spring. The system formed from the base plate, the shoe, the square tube and a part of the cover plate preferably forms a substantially dust-tight unit.

Figure 2:
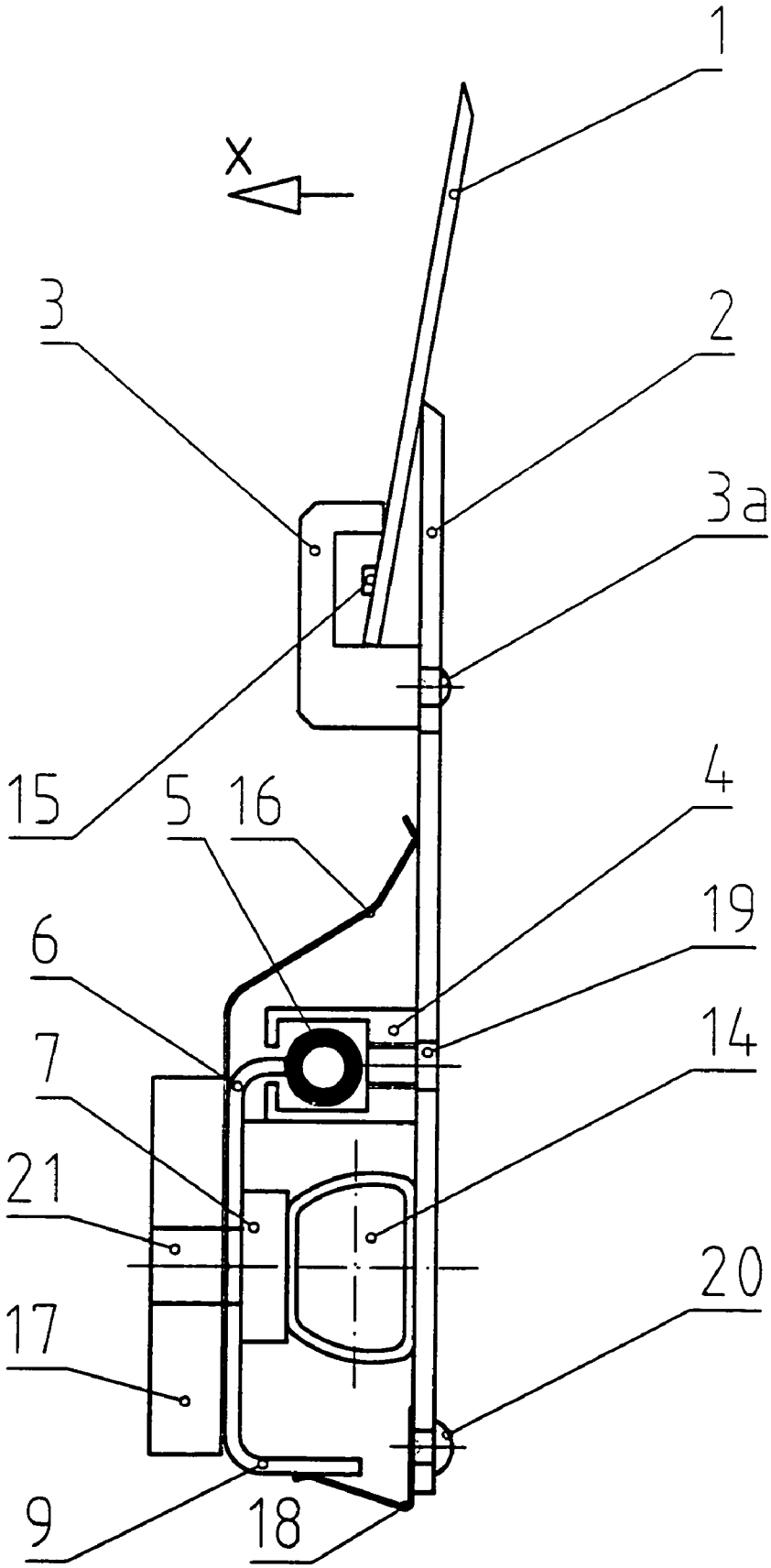

The scraper blade holding device illustrated in FIG. 2 comprises a base plate 6 which is of substantially U-shaped construction and has two short and one long boundary walls. A bearing tube 5 which is a component of the base plate is arranged in the end region of one of the short boundary walls. The bearing tube 5 is mounted within a slotted square tube 4 and rotatable relative thereto through a small angle. This square tube 4 can be installed in segment shape in a direction perpendicular to the plane of the drawing in order to impair the resilience of the cover plate 2 as little as possible.

The square tube is fixedly connected with the cover plate 2, preferably by means of a plurality of screw connections, which are arranged one behind the other perpendicularly to the plane of the drawing, but which are not illustrated in the drawing. The cover plate 2 preferably consists of carbon-fibre material and can comprise several carbon-fibre layers. The cover plate is thereby flexible and can readily adapt to the surface of the respective roll to be cleaned.

Finger devices 3, which are similarly arranged one behind the other perpendicularly to the plane of the drawing, are fastened to the cover plate 2 by means of screw connections 3a in the front end region of the cover plate. The scraper blade 1 is introduced between the cover plate 2 and the finger devices 3. This introduction of the scraper blade preferably takes place by pushing in in axial direction. Since the rear end region of the scraper blade is provided with a rivet or spring 15, the scraper blade cannot, in operation, be pulled out in direction of the roll to be cleaned.

In order to set the respectively desired pressing pressure of the scraper blade against the surface of the roll to be cleaned a pneumatic air hose 5 is provided in the inner region of the U-shaped base plate 6. This hose is provided at one end thereof with an air connection by which air can be forced into the hose and also air can be let out of the hose again. The other end of the hose 14 is closed. A plastics material insert 7 is provided between the hose 14 and the long boundary wall of the U-shaped base plate 6. This is loosely inserted, glued or screw-connected on the inner side of the base plate and prevents the hose 14 from coming into contact with a possibly hot boundary wall in operation of the device.

If the air pressure in the hose 14 is increased, then this expands. This has the effect that in the region of the hose 14 the cover plate 2 is urged away from the base plate 6. This in turn has the consequence that the scraper blade which is fastened in the region of the front end of the cover plate to this, moves in the direction of the arrow x or is pressed in the direction x. The scraper blade is thereby laid against the roll surface to be cleaned and the desired pressing pressure is set by way of a pressure regulating valve.

Moreover, the scraper blade device illustrated in FIG. 2 has in the vicinity of the bearing tube 5 a first spring plate 16, one end region of which is fastened, for example welded, to the base plate 6. The other end region of the spring plate 16 is supported on the cover plate 2, so that this is pressed away for lifting off a scraper device in the case of a blade change. The hose 14 has to be free of pressure for this blade change. The spring plate 16 moreover also serves as dust protection so that no dust can penetrate into the slot of the slotted square tube 4.

In its end region remote from the scraper blade 1 there is fastened to the cover plate 2 by means of a screw connection or rivet connection 20 a second spring plate 18 which bridges over the region between the end of the boundary wall 9 of the base plate 6 and the cover plate 2 and which is supported on the outer side of the boundary wall 9 of the base plate 6. This spring plate 18 also serves as dust protection or dirt sealing.

The spring plate 18 slides along the outer surface of the boundary wall 19 not only during increase in, but also during lowering of the air pressure in the hose 14.

In order to be able to use the scraper blade holding device together with different scraper blade systems present on the market an adapter plate 17 is fixedly connected, for example with use of a screw 21, with the spring plate 16 and/or the base plate 6. This adapter strip 17 is positioned on the outer side, which is remote from the cover plate 2, of the spring plate 16 or the base plate 6.

In FIG. 2 there is shown by all that a novel scraper blade holding device in which the pivot plane of the scraper blade holding device is constructed and arranged in a special manner. The scraper blade holding device illustrated in FIG. 2 requires only one air hose, since bringing about of the initial setting of the cover plate is effected by the force of the plate spring 16. The system formed from the base plate 6, the plate spring 18, a part of the cover plate 2, the square tube 4 and the spring plate 16 preferably forms a substantially dust-tight unit.

REFERENCE NUMERAL LIST

1 scraper blade
2 cover plate
3 finger device
3*a* screw
4 slotted square tube
5 bearing tube
6 base plate
7 plastics material insert
8 spring
9 boundary wall of the base plate
10 shoe for reception of the cover plate
11 slide surface of the shoe
12 rivet
13 slot
14 air hose
15 rivet or spring at the scraper blade
16 spring plate
17 adapter strip
18 spring plate
19 screw
20 screw or rivet
21 screw or stud bolt

The invention claimed is:

1. Scraper blade holding device, comprising a cover plate, a base plate, a first spring plate, a first end region of which is fastened to the base plate and a second end region of which is supported on the cover plate, and a second spring plate which bridges over a region between an end of a boundary wall of the base plate and the cover plate, wherein the cover plate and the base plate are pivotable relative to one another about an axis formed by a bearing tube, wherein finger devices are fastened to the cover plate in the front region of the cover plate, the bearing tube is a component of the base plate and the bearing tube is arranged in the end region of the base plate facing the finger devices.

2. Scraper blade holding device according to claim 1, wherein the cover plate is connected with a slotted square tube and the bearing tube is positioned within the square tube and rotatable relative thereto.

3. Scraper blade holding device according to claim 2, wherein the cover plate together with the square tube fastened thereto is withdrawable from the base plate in an axial direction.

4. Scraper blade holding device according to claim 1, wherein the base plate is contacted by a shoe which is provided for reception of the cover plate and within which the cover plate is mounted to be displaceable in an axial direction.

5. Scraper blade holding device according to claim 4, wherein the shoe together with the cover plate is pivotable relative to the base plate, wherein the base plate has a boundary wall within which slots extending in an radial direction are provided, rivets connected with a slide surface of the shoe being guided through the slots.

6. Scraper blade holding device according to claim 5, wherein the base plate is of U-shaped construction and has two short and one long boundary walls, wherein one short boundary wall has the slots and the other short boundary wall has, in its end region, the bearing tube.

7. Scraper blade holding device according to claim 6, wherein the long boundary wall is provided at its inner side with a plastics material insert.

8. Scraper blade holding device according to claim 4, wherein a spring is arranged in the inner region of the base plate between the base plate and the shoe.

9. Scraper blade holding device according to claim 4, wherein a part of the cover plate, the square tube, the base plate and the shoe form a substantially dust-tight unit.

10. Scraper blade holding device according to claim 1, wherein one end region of the second spring plate is fixedly connected with the cover plate and the other end region of the second spring plate is supported at the outer side of the boundary wall of the base plate.

11. Scraper blade holding device according to claim 1, wherein it comprises an adapter strip which is fixedly connected with the first spring plate and/or the base plate and on which the outer side, which is remote from the cover plate, of the first spring plate and/or the base plate is positioned.

12. Scraper blade holding device according to claim 1, wherein a hose is arranged in the inner region of the base plate between the base plate and the cover plate.

13. Scraper blade holding device according to claim 1, wherein a finger device is fastened to the cover plate and an end region of the scraper blade is insertable between the cover plate and the finger device in axial direction.

* * * * *

UNITED STATES PATENT AND TRADEMARK OFFICE

CERTIFICATE OF CORRECTION

PATENT NO. : 7,665,178 B2
APPLICATION NO. : 10/534224
DATED : February 23, 2010
INVENTOR(S) : Helmut Strauch It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1328 days.

Signed and Sealed this

Seventh Day of December, 2010

David J. Kappos

David J. Kappos
*Director of the United States Patent and Trademark Office*